US006170198B1

(12) United States Patent
Staples et al.

(10) Patent No.: US 6,170,198 B1
(45) Date of Patent: Jan. 9, 2001

(54) PREHUNG DOOR INSTALLATION AID

(75) Inventors: Donald E. Staples, Cape Girandeau; J. Christian Staples, St. Charles, both of MO (US); Jeffrey T. Staples, Herndon, VA (US)

(73) Assignee: Jamlock Manufacturing Company, Inc.

( * ) Notice: Under 35 U.S.C. 154(b), the term of this patent shall be extended for 0 days.

(21) Appl. No.: 09/342,941

(22) Filed: Jun. 29, 1999

(51) Int. Cl.[7] ..... E06B 1/00
(52) U.S. Cl. ..... 49/380
(58) Field of Search ..... 49/380, 501, 504; 411/388, 389, 411, 424, 399, 435

(56) References Cited

U.S. PATENT DOCUMENTS

| | | | | |
|---|---|---|---|---|
| 121,060 | * | 11/1871 | Mutimer | 411/424 |
| D. 319,007 | | 8/1991 | Rogers et al. . | |
| 1,988,925 | * | 1/1935 | Thomson | 411/424 |
| 2,706,837 | | 4/1955 | Jackson . | |
| 2,720,308 | | 10/1955 | Howell, Jr. . | |
| 2,728,956 | | 1/1956 | Jackson . | |
| 2,730,773 | | 1/1956 | Logue . | |
| 3,584,416 | | 6/1971 | Baumgartel . | |
| 3,593,458 | | 7/1971 | Wahlfield . | |
| 4,001,972 | | 1/1977 | Hurwitz . | |
| 4,151,681 | | 5/1979 | Roberts . | |
| 4,483,101 | | 11/1984 | Berzina . | |
| 4,718,195 | | 1/1988 | Ortega . | |
| 4,739,561 | * | 4/1988 | Mills . | |
| 4,884,687 | * | 12/1989 | Steves . | |
| 5,159,782 | | 11/1992 | Sales . | |
| 5,209,017 | | 5/1993 | Ridge . | |
| 5,562,315 | | 10/1996 | Sales . | |
| 5,722,203 | | 3/1998 | Staples et al. . | |

FOREIGN PATENT DOCUMENTS

| | | | | |
|---|---|---|---|---|
| 2718562 | * | 11/1978 | (DE) | 411/435 |

* cited by examiner

*Primary Examiner*—Jerry Redman
(74) *Attorney, Agent, or Firm*—Polster, Lieder Woodruff & Lucchesi

(57) ABSTRACT

An installation aid is provided for maintaining a door closed in a door frame during transportation and installation of a door assembly in a building. The installation aid can be used with both interior and exterior doors. The installation aid is a two piece assembly including a first portion which is received in the door and a second portion which is received on the back side of the strike jamb of the door assembly. The first portion has a head, a stem extending from the head, and a threaded shaft at an end of the stem. The second portion includes a washer and an internally threaded boss extending from the washer. The first portion shaft and second portion boss threadedly engage each other to hold the two pieces together, and hence to hold the door in position in the door frame during shipping and installation of the door.

15 Claims, 2 Drawing Sheets

PREHUNG DOOR INSTALLATION AID

CROSS-REFERENCE TO RELATED APPLICATIONS

Not Applicable

STATEMENT REGARDING FEDERALLY SPONSORED RESEARCH OR DEVELOPMENT

Not Applicable.

BACKGROUND OF THE APPLICATION

This invention relates to doors which are prehung on a door frame, and, in particular to an installation aid which will hold the door closed and square during shipping, delivery, and installation of the prehung door.

The building industry has, for many years, provided to contractors, carpenters, and do-it-yourselfers doors that are prehung on wood frames. The prehung door typically includes a door, a door frame, and two or three hinges which connect the door to the frame. The frame is typically wooden and may be a single frame or a two-piece split frame. The machining of the door and frame to accept the hinges and preparation of the lock and strike are done in a manufacturing facility using equipment specifically designed for this purpose. In addition, interior casing is usually installed on either side of the door if it is installed on a flat one-piece frame, or on both sides, if the door is installed in a split frame. During production of the door assembly, the complete door frame, consisting of two side jambs and a head jamb are nailed together to form a frame around three sides of the door. The top jamb spans the distance between the side jambs at their tops, but nothing connects the side jambs along their bottoms. The side jambs can thus swing relative to each other.

When the complete frame is assembled, the hinges provide proper spacing between the door and the hinge jamb. However, when the other jamb (the strike jamb) is attached to the head jamb, there is nothing to secure it relative to the door. The strike jamb and the head jamb can thus move relative to the door and hinge jamb. To overcome this, many manufacturers use one or two dual headed nails and drive the nails through the back of the strike jamb into the door to temporarily hold the door and the strike jamb in position relative to each other for purposes of shipping. Because the nails have to be removed prior to installation of the door assembly, the manufacturer generally makes no effort to square the door in the frame. Therefore, as part of the installation process, the door installer must square the door in the door frame so that the door will operate properly and easily. When the nails are removed, there is nothing holding the strike jamb in place relative to the door or the hinge jamb. As a result, the prehung door assembly is difficult to handle, and thus is difficult to hang and square. Further, it is difficult to obtain the proper spacing between the door and the frame members. All this also makes it exceedingly difficult for one person to install the door assembly by himself. Additionally, the use of the nails leaves undesirable nail holes in the door and the strike jamb.

Other retaining devices have been provided to hold the door closed for handling and shipping and to eliminate the holes in the door and jamb created by the dual headed nails. However, most retaining devices, like the dual headed nails, must be removed prior to installation of the door in a doorway. As with the dual headed nails, once these devices are removed from the door assembly, there is nothing to hold the assembly together and to hold the door square in the frame. These devices therefore do not make installation of the door assembly any easier.

In our prior U.S. Pat. No. 5,722,203, which is incorporated herein by reference, we disclosed a prehung door installation aid which will hold the strike jamb in place relative to the door during installation of the door as well as during shipping of the door. This installation aid overcame the problems associated with the prior devices. The installation aid was a two piece device. A first piece is received in the back of the door jamb. A second piece is received in the door knob hole and has a post which extends through the bolt hole of the door. The post of the second piece mated with the first piece, and the two pieces were held together by a screw. Although the installation aid worked extremely well, because of the screw required for assembly, it met some resistance by the manufacturers. It would thus be desirable to provide a prehung door installation aid which does not require a separate screw to install the installation aid at the door assembly manufacturing plant.

Additionally, our prior installation aid could only be used with interior doors. It could not be used for exterior doors. It would be desirable to provide an installation aid which will also work with exterior doors.

SUMMARY OF THE INVENTION

Briefly stated, an installation aid is provided for maintaining a door closed in a door frame during transportation of a door assembly and installation of the door assembly in a building. The installation aid can be used with both interior and exterior doors. The installation aid is a two piece assembly. It includes a first portion which is received in the door and a second portion which is received on the back side of the strike jamb of the door assembly. The first portion has a head, a stem extending from the head, and a shaft at an end of the stem. The second portion includes a washer and a boss extending from the washer. The boss has a hole sized to receive the first portion shaft. The first portion shaft and second portion boss engage each other to hold the two pieces together, and hence to hold the door in position in the door frame during shipping and installation of the door. Preferably, the first portion shaft and second portion boss hole are threaded, so that the first and second portion are screwed together.

Bolt heads are provided on the outer surfaces of both the first portion head and the second portion washer so that the two portions can be grasped by a wrench or the like, to rotate the two portions relative to each other.

To keep the door and strike jamb from moving relative to each other after the installation aid has been installed, the first portion stem has a diameter slightly less than the diameter of a standard door bolt hole and the second portion boss has a diameter slightly less than the diameter of a standard strike jamb bolt hole. Additionally, the first portion includes a foot at an end of the stem from which the shaft extends. The foot has a diameter substantially equal to the outer diameter of the second portion boss. Because the various elements of the installation aid are only slightly smaller in diameter than the holes of the door assembly into which they are received, neither the strike jamb nor the door will be able to move substantially relative to the installation aid. Consequently, the strike jamb and the door will not move substantially relative to each other. Thus, the door assembly will be held square during shipping and installation of the door assembly in a building.

BRIEF DESCRIPTION OF THE DRAWINGS

Corresponding reference numerals will be used throughout the several figures of the drawings.

DESCRIPTION OF THE PREFERRED EMBODIMENT

Figure 1:
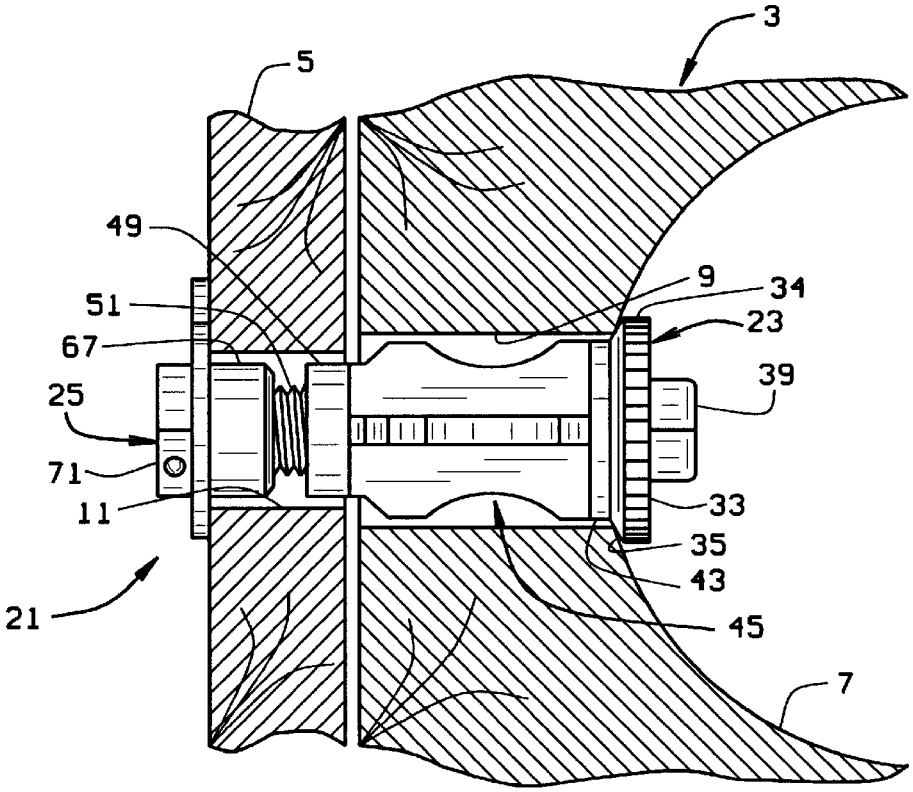
FIG. 1 is a side elevational view of the installation aid installed in a door assembly, the door assembly being shown in cross-section.
Figure 2:
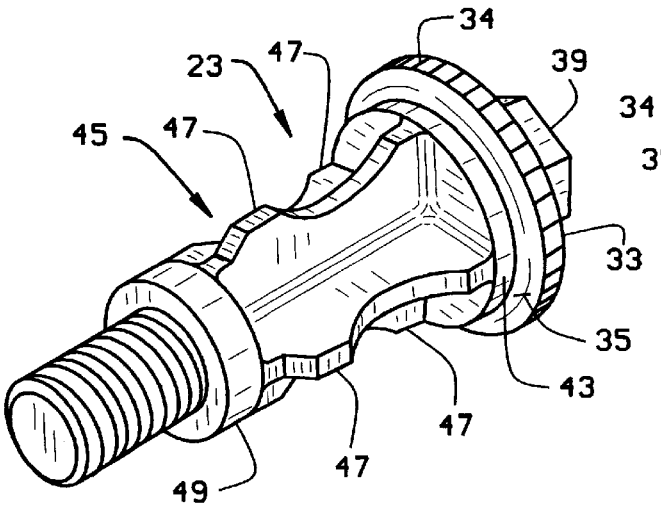
FIG. 2 is a perspective view of a first portion of the installation aid.
Figure 3:
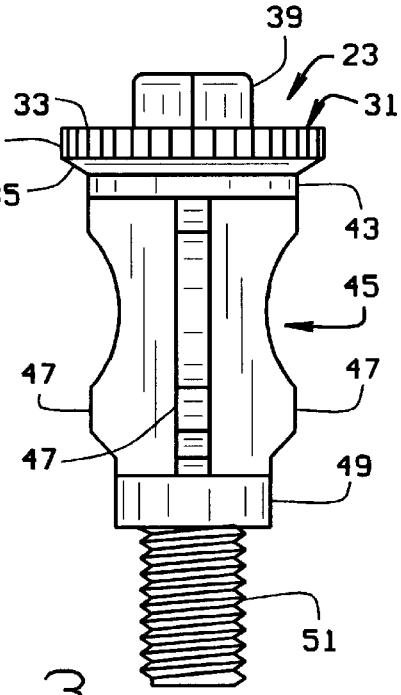
FIG. 3 is side elevational view of the first portion.
Figure 4:
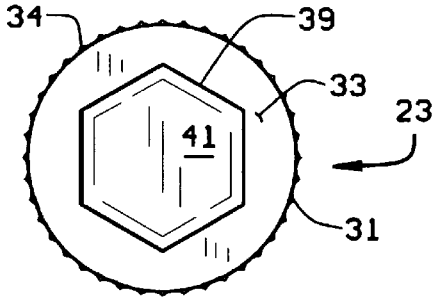
FIG. 4 is a top plan view of the first portion.
Figure 5:
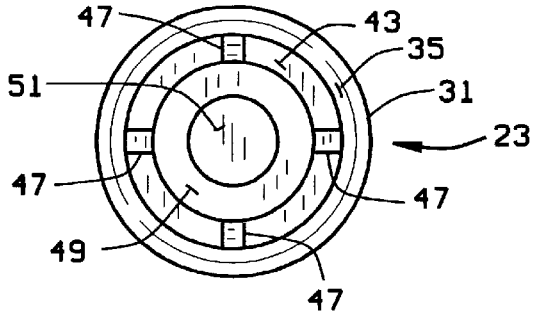
FIG. 5 is a bottom plan view of the first portion.
Figure 6:
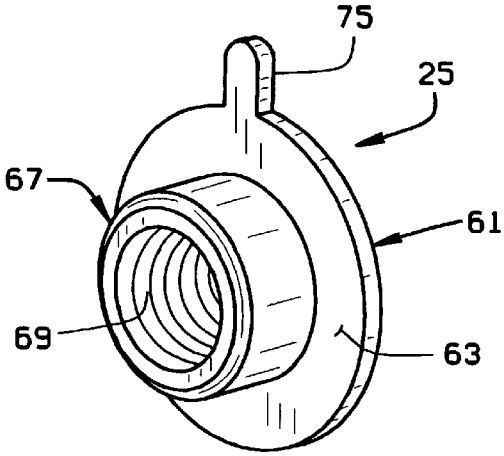
FIG. 6 is a perspective view of the second portion of the installation aid.
Figure 7:
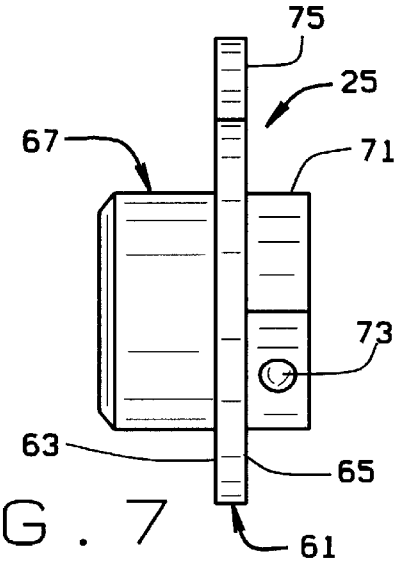
FIG. 7 is a side elevational view of the second portion.
Figure 8:
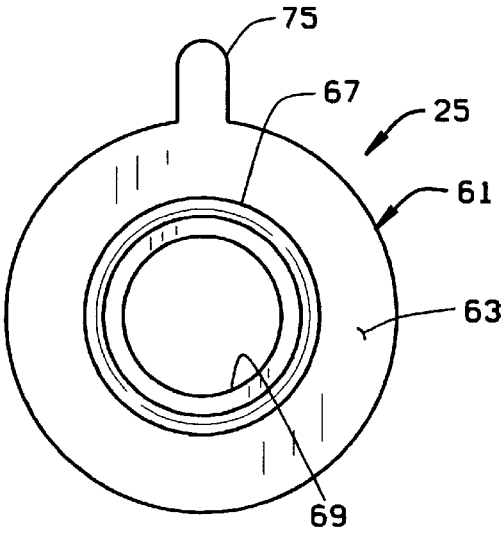
FIG. 8 is a bottom plan view of the second portion.
Figure 9:
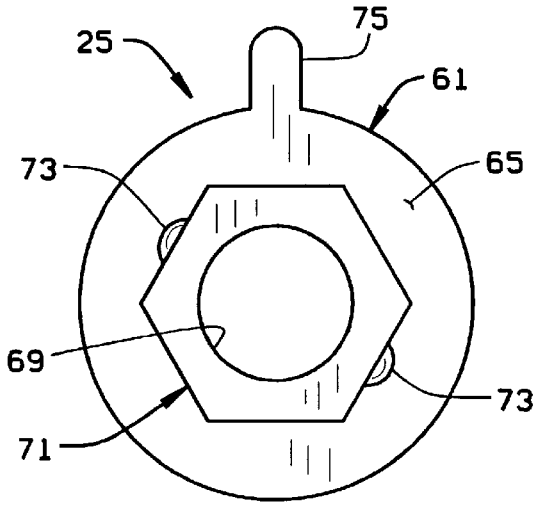
FIG. 9 is a top plan view of the second portion.

The following detailed description illustrates the invention by way of example and not by way of limitation. This description will clearly enable one skilled in the art to make and use the invention, and describes what we presently believe is the best mode of carrying out the invention.

A typical prehung door assembly includes a door 3 which is mounted in a frame. As is known, the frame includes a hinge jamb to which the door is mounted by hinges, a head jamb, and a strike jamb 5. The head jamb extends across the top of the door to connect the hinge and strike jambs. There is nothing which connects the bottoms of the hinge and strike jambs to maintain the door assembly square and the strike jamb 5 can thus move relative to the door 3 and the other frame members. The door 3 includes a door knob hole 7 which extends between the front and back faces of the door, and a bolt hole 9 in the side of the door through which the door knob bolt extends. The strike jamb 5 also has a bolt hole 11 which is aligned with the door knob bolt hole 9 to provide a hole in the jamb 5 into which the door knob bolt can extend to secure the door in its closed position.

An installation aid 21 of the present invention includes a first portion 23 and a second portion 25. The first portion 23 is received in the door 3, is passed through the door knob hole 7 and into bolt hole 9. It extends through the door bolt hole 9 and into the strike jamb bolt hole 11. The second portion 25 is placed on the outer surface of the strike jamb 5 and receives the first portion 23, as will be explained below. The two portions are mated together. Importantly, no screw or other independent fastener is required to hold the first and second portions together. Thus the aid can be installed in a prehung door very quickly and very easily. When installed, the aid 21 will hold the strike jamb 11 in position relative to the door and other frame members. As with our prior device, the installation aid is left in the door assembly while the door assembly is being installed in a doorway. Thus, the door assembly 1 can be squared by the manufacturer and maintained in the square state during shipment and installation of the door assembly. Further, because the strike jamb will not be free to move relative to the door of the head jamb when the installation aid installed in the door assembly, one individual can install the door by himself. Once the prehung door assembly is installed in a doorway, the first portion 23 of the installation aid 21 is removed from the door, to allow the door to swing on the frame. The second piece 25, however, remains with the door. Because of its size, the second piece will not interfere with the operation of the door. Additionally, the installation aid 21 can be used with both interior and exterior doors.

The first portion 23 of the installation aid is shown in detail in FIGS. 2–5. The first portion includes a head 31 having an upper surface 33 and a lower surface 35. The side or edge 34 of the head 31 is preferably knurled. The head is generally circular and has a diameter that is at least slightly larger than the diameter of the door's bolt hole 9. The head 31 limits the extent to which the first portion 23 can extend through the door bolt hole 9. The head's lower surface 35 is preferably slightly sloped or curved. The slope or curvature of the head lower surface 35 approximates the curvature or radius of the door knob hole 7. A standard door knob hole is about 2⅛" in diameter. The radius defined by the lower surface of the head is therefore about 1". Because the lower surface 35 approximates the curvature of the door knob hole, the lower surface 35 will be in contact with the surface of the door knob hole 7 over substantially the full height of the lower surface 35. This makes it easier to turn the first portion to remove the first portion from the door after the door has been installed in a building. The head top surface 33 is generally flat, and a hexagonal bolt head 39 is formed on top of the surface 33. The bolt head 39 is of a standard size, preferably about 9/16" from face to face. Although not shown, the top surface 41 of the bolt head could be provided with a hexagonal hole to receive an alien wrench or with slots to receive a flat head or philips head screwdriver.

A base 43 extends from the bottom surface 35 of the head 31. The base 43 has a diameter which is slightly smaller than the diameter of the door bolt hole 9. A door bolt hole typically is 1" in diameter. The base 43 thus is preferably just slightly less than 1" in diameter so that it can be received in the door bolt hole 9, as seen in FIG. 1. The base 43 helps maintain the first portion generally centered in the bolt hole 9 during installation of the aid 21. It also forms a continuous bearing surface once the installation aid has been installed, and facilitates removal of the first portion 23 from the door after the door has been installed.

A stem 45 extends from the bottom of the base 43. The stem 45 is shown to be made of four splines or blades 47 extend from a center axis of the stem and which intersect at substantially right angles with each other. The stem 45 has a diameter that is also slightly less than 1", so that stem will extend through the door bolt hole 9. The splines 47 are relieved, or have cut-outs formed in them. These cut-outs are aesthetic, and can be made in any desired shape. They also serve to remove some of the material which would be present in the spline if its side edges were straight. The removal of the material reduces the material costs of the device. It also serves to reduce the overall weight of the installation aid 21. This weight reduction becomes important during shipping of a box of installation aids. Although the stem 45 is made of four splines, it could be made of more or fewer splines. Additionally, it could be a solid cylinder or other solid polygon (i.e., a square or hexagonal), with or without cutouts equivalent to the cutouts.

A foot 49 is formed at the end of the stem 47. The foot 49 is smaller in diameter than the stem, and is preferably slightly smaller than the diameter of the strike jamb hole 11. The stem 45 is beveled at its end to come down to the smaller diameter. The reduced diameter of the stem at the foot helps with introducing the first portion into the door bolt hole 9 through the door hole 7. The stem 45, from the top of the base 43 to the bottom of the foot 49 is sized so that the foot 49 will be received in strike jamb hole 11. The back edge of the foot 49 will be about even with the inner edge of the strike 10 jamb 5. Preferably the foot 49 is about ¾" in diameter, which is slightly smaller than the diameter of the strike jamb hole 11. A threaded shaft 51 extends from the foot 49. The shaft 51 is about ¾" long. The threaded shaft 51 is sized to extend through the strike jamb hole 11.

The second portion 25 includes an integral washer 61 having a front surface 63 i15 and a back surface 65. The washer 61 has a diameter which is larger than the diameter of the strike jamb bolt hole 11. A boss 67 extends from the washer's front surface 63. The boss 67 has an outer diameter of about ¾", so that it can be received in the strike jamb hole 11. As with the foot 49 of the first portion 21, the diameter of the boss 67 is only slightly less than the diameter of the strike jamb hole 11. The boss 67 is hollow, defining a hole 69 which is internally threaded. The threaded hole 69 is sized to mate with the threaded shaft 51 of the first portion 23. A hexagonal bolt head 71 is formed on the washer's back surface. The bolt head 71 is also of a standard size, preferably, about 9/16". The bolt head 71 and boss 67 are both formed generally in the center of the washer 61. The hole 69 extends through both the boss 67 and the bolt head 71. Preferably, the threads extend approximately ¾ of length of the hole 69, with the forward ¼ of the hole 69 being unthreaded. This facilitates application of the second portion 25 onto the threaded shaft 51 of the first portion 23. A pair of projections 73 are formed on a pair of the faces of the hex head 71. As can be appreciated, the projections 73 help a socket wrench to frictionally hold the head 71 in its socket when the installation aid is being installed in a door assembly at the manufacturing plant. Lastly, the second portion 23 includes a small arm 75 extending from an edge of the plate 61.

To install the installation aid 21 in a door assembly, the first portion 21 is inserted into the door's bolt hole 9 through the door's door knob hole 7 until the head's back surface 35 engages the side of the hole 7. The shaft 51 will then extend through the door bolt hole 9 and through the strike jamb hole 11 to be exposed on the outer surface of the strike jamb 5. The second portion 25 can then be applied to the first portion shaft 51. Because bolt heads are provided on both portions of the installation aid 21, either portion can be rotated relative to the other to install the aid 21 in the door. The diameter of the base 43 and stem 45 will help hold the installation aid generally centered in the bolt hole 9. Additionally, as noted above the first portion base 43 and stem 45 have a diameter that is only slightly smaller than the diameter of the door bolt hole 9 and the diameter of the first portion foot 49 and second portion boss 67 are only slightly less than the diameter of the strike jamb hole 11. Thus, when the aid 21 is installed in the door, the strike jamb 5 will not be able to move substantially relative to the door 3. The desired gap between the door and strike jamb can be maintained by the use of spacers, as is known.

As noted above, the foot 49 of the first portion 23 extends from the edge of the door and into the strike jamb hole 11. The threaded shaft 51 extends at least part way through the strike jamb bolt hole 11. Preferably, the shaft 51 extends through the bolt hole 11, to protrude at least slightly from the opposite side of the strike jamb. With the threaded shaft 51 extending from the back side of the strike jamb, an assembly worker will simply thread the second portion 25 onto the first portion shaft 51. The second portion boss 67 will then be received in the strike jamb hole 11. This can be done manually (i.e., using fingers), using a manual socket wrench, or using a power socket wrench.

As can be seen in FIG. 1, both the first portion foot 49 and the second portion boss 67 are in the strike jamb hole 11 and are only slightly smaller than the strike jamb hole. Thus, the foot 49 and boss 67 operate as bearing surfaces, and substantially no forces are borne by the shaft 51. Thus, the shaft 51 will not be sheared off the foot 49 by jostling of the door assembly during transportation or shipment of the door assembly. Additionally, the first portion will be easier to remove from the second portion and the door after installation of the door assembly.

At the installation site, the door is installed in a doorway with the installation aid 21 in place. Once the door is installed, the first portion 23 is removed from the door. The installer can use a socket wrench which will fit on the hex head 39 of the first portion 23 to remove the first portion 23 from the door. Once the first portion has been loosened, the first portion 23 can be removed by hand (i.e., finger loosened). The knurled edge 34 of the first portion head 31 will facilitate an installer in grasping the head to remove the first portion 23 from the second portion 25 by hand. The second portion 25 remains in the door. Because the second portion boss 67 is short (it extends only about ½ the width of the jamb 5), it will not interfere with the operation of the door knob bolt. The first portion 23 can be loosened prior to installation of the door (for example by rotating the second portion). This will make it easier to remove the first portion 23 from the door after the door has been installed, without affecting the ability of the aid 21 to hold the door closed during installation of the door.

If the connection between the first and second parts is tight, the second part may rotate with the first part, making it difficult to remove the first portion 21 from the door. The arm 75 on the second portion 25 prevents the second portion from rotating more than a full 360°. Some door frames have lips or shoulders on their outer surfaces. The arm 75 will engage the lip or shoulder, and prevent the second portion 25 from rotating more than a full circle. The arm 75 will thus hold the second portion 25 in place while the first portion 23 is removed from the door.

The first and second portions are preferably molded of plastic and each is formed as a single, unitary piece.

As can be appreciated, the installation aid 21 of the present invention is installed in the door assembly by the manufacturer without marring the door. It thus leaves no visible marks on the door or door frame. Additionally, because the installation aid does not use a screw or other fastener to hold the two portions together, an assembly worker does not have to align screw holes in the two parts and drive a screw through the two parts to install the installation aid. Because the second portion 25 of the installation aid remains attached to the outer surface of the strike jamb 5, the door can be kept in its closed position during installation of the door assembly in a building. Thus, all the elements of the frame will be secured in position during installation, and the strike jamb will not be free to move relative to the door during installation. The door assembly can therefore be installed by a single individual. Further, because the door assembly is installed in a doorway in its closed position, the manufacturer can square the door in the door frame prior to shipping. The door assembly, as installed will therefore be squared and the installer will not have to square the door in the door frame. This obviously eliminates a difficult step for the do-it-yourselfer.

As variations within the scope of the appended claims may be apparent to those skilled in the art, the foregoing description is set forth only for illustrative purposes and is not meant to be limiting. For example, although the first portion shaft 51 and the second portion boss 67 are preferably threaded, one of the two could be provided with a pin, and the other could be provided with an L-shaped channel to provide a key-slot type of engagement between the first and second portions. This example is merely illustrative.

What is claimed is:

1. An installation aid for maintaining a door closed in a door frame during transportation and installation of a door assembly in a building, the door assembly including a door having a door knob hole in a face of the door and a bolt hole in a side edge of the door and a strike jamb having a bolt hole; said installation aid comprising:

a first portion receivable in said door and including a head, a stem extending from said head, and a shaft at an end of said stem;

a second portion receivable in said strike jamb and including a washer and a boss extending from said washer; said boss having a hole; said first portion shaft being received in said second portion boss hole, said first portion shaft and second portion boss removably engaging each other; said second portion being sized to remain with the door assembly after the door assembly has been installed in a building.

2. The installation aid of claim 1 wherein said first portion shaft and said second portion boss hole are threaded, said first and second portion being threadably connectable to each other.

3. The installation aid of claim 1 wherein said second portion includes a bolt head on an outer surface of said washer.

4. The installation aid of claim 1 wherein said first portion head includes an outer surface, said outer surface being adapted to be engaged by a tool to rotate said first portion relative to said second portion.

5. The installation aid of claim 4 wherein said first portion head includes a bolt head on said outer surface which can be engaged by a wrench.

6. The installation aid of claim 1 wherein said stem has a diameter slightly less than the diameter of a standard door bolt hole and said second portion boss has a diameter slightly less than the diameter of a standard strike jamb bolt hole.

7. The installation aid of claim 6 wherein said first portion includes a foot at an end of said stem; said shaft extending from said foot; said foot having a diameter substantially equal to the outer diameter of said second portion boss.

8. The installation aid of claim 1 wherein said stem has an axis and includes a plurality of splines extending from said axis.

9. The installation aid of claim 1 including a base beneath said first portion head; said stem extending from said base; said base having a diameter slightly less than the diameter of a standard door bolt hole.

10. The installation aid of claim 1 wherein the second portion includes an arm extending from an edge of said washer.

11. The installation aid of claim 1 wherein said head includes a lower surface; said lower surface being curved or beveled to define a radius, said lower surface radius approximating the radius of a standard door door knob hole.

12. The installation aid of claim 11 wherein said radius of said head lower surface is about 1".

13. An installation aid for maintaining a door closed in a door frame during transportation and installation of a door assembly in a building, the door assembly including a door having a door knob hole in a face of the door and a bolt hole in a side edge of the door and a strike jamb having a bolt hole; said installation aid comprising:

a first portion receivable in said door and including a head, a stem extending from said head, and a shaft at an end of s aid stem, said stem extending through the door bolt hole;

a second portion receivable in said strike jamb and including a washer and a boss extending from said washer;

said first portion shaft being removably engageable with said second portion boss to hold the door closed in the door frame during transportation of the door assembly and installation of the door assembly in a building;

said first portion being removable from said second portion after the door assembly has been installed in a building and said second portion being sized to remain with the door assembly after the door assembly has been installed in a building.

14. The installation aid of claim 13 whe rein said first portion is a unitary, one-piece member and said stem is integral with said head.

15. The installation aid of claim 13 wherein said second portion boss has a length less than the width of the strike jamb.

* * * * *

UNITED STATES PATENT AND TRADEMARK OFFICE

CERTIFICATE OF CORRECTION

PATENT NO. : 6,170,198 B1
DATED : January 9, 2001
INVENTOR(S) : Staples et al.

It is certified that error appears in the above-identified patent and that said Letters Patent is hereby corrected as shown below:

Column 4,
Line 22, replace "alien" with -- allen --;
Line 36, replace "47 extend" with -- 47 which extend --;
Line 37, replace "and which intersect" with -- and intersect --;

Column 5,
Line 2, delete "i15";

Column 8,
Line 37, replace "whe rein" with -- wherein --.

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*